United States Patent [19]

Seligman et al.

[11] 4,256,126

[45] Mar. 17, 1981

[54] SMOKABLE MATERIAL AND ITS METHOD OF PREPARATION

[75] Inventors: Robert B. Seligman; Gus D. Keritsis, both of Richmond, Va.

[73] Assignee: Philip Morris Incorporated, New York, N.Y.

[21] Appl. No.: 930,332

[22] Filed: Aug. 2, 1978

[51] Int. Cl.[3] ..... A24B 15/12; A24B 15/16; A24B 15/24; A24B 15/42

[52] U.S. Cl. ..... 131/17 A; 131/140 C

[58] Field of Search ..... 131/8 R, 9, 15 R, 15 C, 131/17, 140 C, 2

[56] References Cited

U.S. PATENT DOCUMENTS

| | | | |
|---|---|---|---|
| 3,529,602 | 9/1970 | Hind et al. | 131/140 C |
| 3,628,541 | 12/1971 | Buchmann | 131/140 C |
| 3,744,496 | 7/1973 | McCarty et al. | 131/15 R |
| 3,818,915 | 6/1974 | Anderson | 131/2 |
| 3,844,294 | 10/1974 | Webster | 131/2 |
| 3,874,390 | 4/1975 | Eicher et al. | 131/2 |
| 3,892,244 | 7/1975 | Anderson | 131/2 |
| 3,894,543 | 7/1975 | Anderson et al. | 131/2 |
| 3,897,791 | 8/1975 | Yasui et al. | 131/2 |
| 3,897,792 | 8/1975 | Yasui et al. | 131/2 |
| 3,924,644 | 12/1975 | Anderson et al. | 131/2 |
| 3,943,941 | 3/1976 | Boyd et al. | 131/2 |
| 3,943,942 | 3/1976 | Anderson et al. | 131/17 R |
| 3,965,911 | 6/1976 | Anderson et al. | 131/2 |
| 4,008,723 | 2/1977 | Borthwick et al. | 131/2 |
| 4,014,348 | 3/1977 | Garner | 131/2 |
| 4,014,349 | 3/1977 | Morman et al. | 131/2 |

FOREIGN PATENT DOCUMENTS

| | | | |
|---|---|---|---|
| 2206185 | 8/1972 | Fed. Rep. of Germany | 131/2 |
| 1692921 | 7/1974 | Fed. Rep. of Germany | 131/2 |
| 2212745 | 7/1974 | France | 131/2 |
| 25830 | of 1903 | United Kingdom | 131/140 C |
| 1362613 | 8/1974 | United Kingdom | 131/2 |
| 1364103 | 8/1974 | United Kingdom | 131/2 |
| 1364104 | 8/1974 | United Kingdom | 131/2 |
| 1385754 | 2/1975 | United Kingdom | 131/2 |
| 1415893 | 12/1975 | United Kingdom | 131/2 |
| 1445124 | 8/1976 | United Kingdom | 131/2 |

OTHER PUBLICATIONS

*Tobacco and Tobacco Smoke* by Wynder, et al., pp. 54 & 55 cited Academic Press, N.Y., N.Y. 1967.

*Primary Examiner*—V. Millin

*Attorney, Agent, or Firm*—Watson, Leavenworth, Kelton & Taggart

[57] ABSTRACT

A method of producing a smokable material having reduced particulate matter, particularly tar, nicotine and puff count, while still maintaining the desirable characteristics of a smoking material is disclosed. The method comprises pyrolyzing a carbohydrate material to a weight loss of at least 10%, forming a slurry of tobacco-parts, adding the pyrolyzed carbohydrate material to the slurry, homogenizing the slurry and processing the resultant product to a form desired for the smoking material. The smokable material obtained by such method is also described.

31 Claims, No Drawings

SMOKABLE MATERIAL AND ITS METHOD OF PREPARATION

BACKGROUND OF THE INVENTION

1. Field of the Invention

This invention pertains to the field of smoking materials. More particularly, the present invention concerns a method for preparing a smoking material having reduced tar, nicotine and puff count while still maintaining the desirable characteristics of a smoking material.

2. Description of the Prior Art

It is well known that during the stripping of leaf tobacco in preparation for its use for cigar wrappers or filler, cigarettes and smoking tobacco, a substantial quantity of stems and leaf scraps remains as by-product although some of it has been used for making snuff and for mixture with chewing and smoking tobacco. In addition, there is the tobacco scrap and dust resulting from shipping, handling and other causes. Inasmuch as this so-called by-product is high grade, flavorful tobacco, numerous proposals for its economic use have been made, principally its conversion into the form of synthetic leaf or "reconstituted" tobacco made by adhesively binding finely ground tobacco and forming the mixture into sheets, ribbons, or the like, and substituting the same in whole or in part for natural leaf in cigars, cigarettes, smoking tobacco and other tobacco products. Such techniques are described, for example, in U.S. Pat. Nos. 3,409,026 and 3,386,449.

Although the reconstituted tobacco is made from by-product tobacco, i.e., stems, dust, fines, etc., it nevertheless possesses the same tar, nicotine, and other characteristics associated with natural leaf tobacco. Accordingly, it would be highly desirable to develop a method by which certain constituents of the reconstituted tobacco are reduced while still maintaining the natural flavor and aroma of the tobacco.

Reduction of tar and nicotine in tobacco leaf material has been attempted by incorporating a carbohydrate or cellulosic material which has been thermally degraded in an inert atmosphere (commonly referred to as "pyrolyzed") into the tobacco. Such techniques are disclosed, for example, in U.S. Pat. Nos. 3,545,448; 3,861,401; 3,861,402; and 4,019,521.

Such techniques suffer from many disadvantages. In particular, these techniques require that the pyrolyzed carbohydrate material be blended with the tobacco leaf material while in a dry state. This not only produces a product which is nonuniform, has variable smoking and physical characteristics, but also, produces an undesirable amount of dusting during such processing.

Moreover, this art is specifically directed to, inter alia, reducing the tar and nicotine content of tobacco leaf material and is not at all concerned with combustible reconstituted tobacco as such for use in a smoking material. Reconstituted tobacco in this art is used only to the extent that a solvent extract is made therefrom and the soluble fraction thereof is applied to the pyrolyzed carbohydrate material to impart a tobacco color and aroma. Hence, the art is devoid of any teaching as to the effect of the combustion of pyrolyzed carbohydrate material in conjunction with reconstituted tobacco per se, how such a combination is to be effected (due to the physical characteristics of the particular materials) or what other parameters and variables are involved in order to make a smokable product.

U.S. Pat. No. 3,805,803 discloses a method by which the tar and nicotine content of a reconstituted tobacco smoking materal is reduced. The reduction of these components is accomplished by incorporating activated carbon into the reconstituted tobacco material. The use of carbon, however, presents many disadvantages. In particular, when paper making process is used to produce the reconstituted tobacco, the fine carbon particles interfere with the proper drainage (dewatering) of the tobacco pulp by plugging up the Fourdrinier wire holes or by sticking to the so-called Yankee dryer used to make a paper-like web. It also produces a filler which when used in smoking products introduces an unacceptable off-taste, normally being referred to by those skilled in the art as a "carbon" taste. Moreover, the use of activated carbon in cigarettes produces unacceptable smoking products in that "fiery" particles of glowing charcoal drop off the burning end of a cigarette thus creating a nuisance to the smoker. The "fiery" particles and the "carbon" off-taste are also evident when the material described in U.S. Pat. No. 3,744,496 is used in cigarettes.

SUMMARY OF THE INVENTION

Applicants have discovered a method for producing a smokable material which makes use of combustible reconstituted tobacco, which material delivers reduced particulate matter, particularly tar, and less nicotine while still maintaining the natural flavor and aroma of natural tobacco.

This method not only avoids substantially all of the above-noted disadvantages associated with prior art techniques, but additionally, produces a smokable material which has reduced tar and nicotine content at least equal to that associated with activated carbon but without its inherent drawbacks.

More particularly, the present invention is directed to a method of producing a smokable material which comprises pyrolyzing a carbohydrate material in an inert or reducing atmosphere to a weight loss of at least 10%, forming a slurry of tobacco-parts, adding the pyrolyzed carbohydrate material to the slurry, homogenizing the slurry and processing the resultant product to a form desired for the smoking material.

Additionally, applicants have discovered that if an alkali metal salt of a lower carboxylic acid, carbonate, bicarbonate or phosphate is added to the homogenized slurry, the reduction of tars, nicotines, etc., is improved in the final product.

Still further, applicants have discovered that the addition of a lower carboxylic acid or derivative thereof or the metallic salt of these acids to the homogenized slurry improves the burning, taste, and aromatic qualities of the resultant product.

This invention provides a smokable material of reconstituted tobacco, having low tar and nicotine content while still maintaining the aromatic and flavor qualities of natural tobacco and avoids the disadvantages associated with prior art processes. This process, therefore, is highly desirable not only from an economic point of view, but also, from a marketing point of view. This invention produces a smokable material which is low in cost, formed of readily available materials, makes use of so-called by-product materials and is produced in a simple and efficient manner.

DESCRIPTION OF THE PREFERRED EMBODIMENT

The method of producing the smokable material of the present invention is carried out as follows.

A heat treated carbohydrate material is first prepared. The method of producing such materials is old in the art. (See, for example, U.S. Pat. No. 4,019,521, incorporated herein by reference.)

Generally, the heat treated carbohydrate material is prepared by subjecting a carbohydrate material to thermal degradation at a temperature of about 100° to 850° C., and preferably about 200° to 750° C. in an inert or reducing atmosphere.

Particularly suitable carbohydrate materials include, for example, alpha-cellulose, wood pulp, paper pulp, straw, flax, bamboo, esparto grass, kenaf fibers, cotton, hemp, rice fibers, and vegetable fibers, plant parts, coffee or peanut hulls, and the like. Instead of cellulosic materials of the type described above, cellulosic derivatives may also be used. Such derivatives include methyl cellulose, carboxymethyl cellulose and the like. Other carbohydrate materials such as starch, pectin, gum, alginates and the like may also be used, as well as polyvinyl alcohol.

The cellulose or carbohydrate materials can be subjected to the thermal degradation process in any desirable form such as powders, sheet or fabric form, but it is preferred to carry out the described thermal treatment while the cellulose or carbohydrate material is in discrete particles, such as chips, shreds, etc.

In a batch operation, the material is simply loaded into an enclosed chamber in which the specific conditions are provided. Thereafter, the material is heated to the temperature for thermal degradation and maintained at such temperature for the desired length of time. It is preferable, however, in order to reduce the costs involved, to carry out the thermal treatment in a continuous manner wherein the carbohydrate or cellulosic material is placed on a moving conveyor belt which passes through the inert or reducing atmosphere enclosed heated chamber at a rate sufficient to achieve the desired degree of thermal degradation.

The inert atmosphere in which the thermal treatment is carried out is preferably that of nitrogen gas, although other inert, non-oxidizing gasses, such as carbon dioxide, helium and the like may also be used. Alternatively, the non-oxidizing atmosphere can also be obtained by carrying out the thermal degradation of the cellulosic material under vacuum conditions. A reducing atmosphere can be obtained by preventing excessive air from entering the hot chamber.

As a result of the thermal degradation or pyrolysis of the cellulosic or carbohydrate material, the material experiences a weight loss during the treatment of desirably at least 10% up to 95% and preferably from about 20 to 85%.

The reconstituted tobacco used in the smokable material of the present invention is prepared by any of the processes well known in the art for preparing reconstituted tobacco. (See, for example, U.S. Pat. No. 3,409,026 incorporated herein by reference.)

In general, the tobacco-parts slurry used in making the reconstituted tobacco is formed in the following manner. Tobacco by-product materials, such as stems, dust and fines are first ground. This ground tobacco material is then mixed with water to form a slurry. It is desirable to form the slurry such that about 10 to 80% tobacco by-product material is present based on a total weight of the slurry.

To this tobacco slurry, an adhesive binder is then added in order to bond the tobacco constituents together upon subsequent processing. The bonding material is preferably one that is derived from natural tobacco parts. It has been found that such an adhesive imparts no undesirable characteristics and properties to the ultimate end product. Preferably, a tobacco derived pectin adhesive binder is used. The tobacco pectins may be produced or liberated in the slurry in situ or may be produced and isolated in another tobacco slurry. The method by which these tobacco pectins are produced are set forth in the above-mentioned patent, U.S. Pat. No. 3,409,026. Typically, about 5 to 40 parts of binder is present per 100 parts of tobacco material present in the slurry.

Of course, binders that are not derived from natural tobacco parts may also be employed. Thus, binders such as modified cellulose or natural gums, particularly alginates, carboxymethyl cellulose or its sodium salt (NaCMC), ethyl hydroxyethyl cellulose, guar gum and other gums, etc., may be employed in the present invention in lieu of the pectin adhesive binder.

The pyrolyzed carbohydrate material is now to be added to the tobacco-parts slurry. Prior to its addition, however, it is desirable that the pyrolyzed material be first pulverized. In particular, it is desirable to pulverize the carbohydrate material to about 0.1 to 450$\mu$ in diameter and preferably less than about 300$\mu$ in diameter.

One of the novel features of the present invention is the fact that the pyrolyzed carbohydrate material is blended with the reconstituted tobacco while the latter is still in slurry form rather than blending it dry, and more importantly, the manner in which the carbohydrate material is added, i.e., by homogenization, to the tobacco-parts slurry. More particularly, applicants have found that the desirable properties of the smokable material produced by the method of the present invention is obtained, in part, as a result of the manner in which the pyrolyzed carbohydrate material is combined with the tobacco-parts slurry. Thus, after the pyrolyzed carbohydrate material is added to the slurry, the entire slurry must then be homogenized. This homogenization step is critical to the method of the present invention.

More particularly, the homogenization step is carried out by passing the slurry, containing the tobacco-parts and pyrolyzed carbohydrate material, through a series of refiners such as a Sprout Waldron refiner. Other mechanical/pressure type refiners which are known to the art may, of course, also be employed in the present invention. The slurry is fed through the refiner at a rate of about 2.5 gal/min with a back pressure being maintained at about 60 psi. These processing parameters for the homogenization step are important in order that the resulting homogenized slurry is a uniformly thoroughly blended mixture. Unlike other prior art processes, such a uniformly blended homogeneous mixture cannot be obtained between pyrolyzed carbohydrate material and reconstituted tobacco when mixed in dry form. Such a dry-mixed material produces a non-uniform product which is characterized by variations in taste and in tar delivery from one puff to the next, dustiness, falling "fiery" particles and uneven burning.

In complete contrast, it is by means of the utilization of the homogenization step that the present process is able to produce a product which is indeed uniform throughout in its composition. This contributes to the improved flavor and burning characteristics of the resulting product in addition to the reduction of tar and nicotine on a puff-by-puff and total overall basis.

Typically, about 5 to 80% and preferably about 20 to 60% (dry weight basis) of the pyrolyzed carbohydrate material is added to the slurry. Applicants have found that the greater the amount of pyrolyzed carbohydrate material used, the greater the reduction of particulate matter associated with the smokable material produced. However, an excess of the pyrolyzed carbohydrate material is undesirable inasmuch as the flavor and aromatic characteristics of the smokable material are reduced when the amount of reconstituted tobacco is proportionately decreased. Consequently, the maximum amount of pyrolyzed carbohydrate material that can be added to the tobacco-parts slurry and yet produce a product which possesses the desirable properties and characteristics of tobacco is about 70% based on the total dry weight of the slurry.

In addition to the pyrolyzed carbohydrate material, the homogenized slurry may also contain materials which are normal constituents of smoking mixtures, such as natural leaf tobacco, untreated carbohydrate or other smoke-producing organic material and, as desired, any of the other modifying agents commonly used in smoking material. For example, the slurry may contain glow-promoting catalysts, materials to improve ash coherence, flavorants, medicaments, humectants, and the like. All of these materials are well-known to one skilled in the art.

In addition to the incorporation of the above-noted modifying agents, applicants have also discovered that the presence of particular constituents enhances the smoking characteristics of the end product particularly, the taste, aromatic, and burning characteristics thereof, and/or improves the efficiency of reducing the various smoke components such as tar, nicotine, etc.

More particularly, applicants have discovered that the addition of an alkali metal salt to the homogenized slurry aids in the reduction of the various smoke components, such as tar, nicotine, etc. The alkali metal salt can be a salt of a lower carboxylic acid, carbonate, bicarbonate, or phosphate. Suitable carboxylic acids include oxalic acid, citric acid, pivalic acid, maleic acid, malic acid, malonic acid, malonic acid derivatives such as the methyl, dimethyl, ethyl, sec-butyl, isopropyl derivative thereof, valeric acid, isovaleric acid, acetic acid, and the like. The amount of alkali metal salt added to the homogenized slurry is generally about 0.3 to 10% and preferably about 1 to 6% based on the total dry weight of the slurry composition. Suitable alkali salts include sodium carbonate, sodium citrate, potassium carbonate, potassium citrate, and the like.

Furthermore, applicants have also discovered that the addition of particular acids or their derivatives to the homogenized slurry enhances the taste and aromatic characteristics of the smokable material produced. Such acids include formic acid, acetic acid, propionic acid, butyric acid, valeric acid, methyl valeric acid, isovaleric acid, sec-butyl malonic acid, isopropyl malonic acid, ethyl malonic acid, methyl malonic acid, dimethyl malonic acid, and the like. The metallic salts of these acids, such as sodium, potassium, magnesium, or calcium salts, or their ammonium salts, are also applicable. It is desirable to use about 0.2 to 10% and preferably about 0.3 to 5% of the acid material in the homogenized slurry based on the total dry weight of the slurry.

The homogenized slurry is thereafter processes to form the desired smoking material. Thus, the slurry may be cast directly, or passed through a conventional paper-making machine, dried and cut into particulate material similar in physical form to ordinary smoking tobacco and so used, mixed with tobacco leaf cut or shredded in the usual manner. The product may be cast, coated, paper-made or extruded in sheet form, in blocks or as threads or other shapes, as desired. When in the form of a sheet or strip, the smokable material can be slit into thin strips for twisting or intertwisting with other strips to form strands which can be cut to lengths suitable for use in filling machines for the fabrication of cigars, cigarettes or as a pipe tobacco substitute. The strands of the smokable material so produced can be used alone or, if desired, can be intertwisted with strands of natural tobacco for admixture therewith in various proportions to produce a smokable material.

Generally, the sheets are initially formed to a thickness of about 10 to 100 mils depending on the slurry dry solid content to produce final sheets whose ultimate dry thickness is in the range of from about 4 to 14 mils. Generally, a dry thickness of over 9 mils is usually associated with a foamed/expanded product. The sheets are dried at a temperature of about 75° to 350° C. to a moisture content of about 10 to 40% and preferably to about 15 to 35%. Methods of forming continuous sheets of reconstituted tobacco are generally known in the art and further details need not be described here. Representative of this type of procedure is disclosed in U.S. Pat. No. 2,734,513, incorporated herein by reference.

Having described the basic concepts of this invention, the following examples are being set forth to illustrate the same. They are not, however, to be construed as limiting the invention in any manner. All parts and percentages in the examples are by weight.

EXAMPLE 1

A sheet of alpha-cellulose having a thickness of approximately 28.5 mils was first formed. The sheet was passed through an oven heated to a temperature of 350° C., having an inert atmosphere of nitrogen gas therethrough. The cellulose sheet was advanced through the oven by means of a conveyor belt at a rate of exposure that provided a weight loss of about 60%. The pyrolyzed cellulosic material still remained in sheet form and had strong mass integrity upon exiting the oven. The pyrolyzed cellulose material was then pulverized to a diameter of about 500μ in preparation for its incorporation into the tobacco-parts slurry.

The tobacco-parts slurry was made by adding 9 pounds of tobacco by-product materials, such as tobacco stems, fines and dust to 100 pounds of water. Prior to its being added to the water, however, the tobacco by-product was first ground to a diameter of about 420μ. To this slurry, which contained about 1 pound tobacco extracted binder (pectin), 1 pound of sodium carboxymethyl cellulose gum adhesive was also added.

After being mixed, the slurry, Sample A, was then homogenized without the addition of any pyrolyzed cellulosic material. This sample consisted of 9 parts tobacco and 1 part NaCMC and was to serve as a control. To a second sample which was made by adding 11.34 pounds of the same tobacco by-product that was used to make Sample A and which contained about 1.1 pounds of tobacco binder (pectin), two pounds of NaCMC and 6.66 pounds of the pyrolyzed alpha-cellulose were added to 200 pounds of water. After the slurry was mixed and homogenized, it was divided into two aliquots, Sample B and Sample C. Each of the samples, B and C, consisted of: 5.67 parts tobacco, 1.0 part NaCMC and 3.33 parts pyrolyzed alpha-cellulose material.

All three of the samples were homogenized by passing them twice through a Sprout Waldron disc plate refiner at a rate of 2 gal/min. The very close tolerance between the refiner disc plate caused the slurries to rise in temperature from 60° C. to 80° C. The back pressure at the refiner exit was about 20 psi. NOTE: In a normal production run, back pressures of up to 60 psi could be used to increase the residence time of the slurry in the refiner.

Each of the respective homogenized slurries was then cast into sheets having a thickness of approximately 70 mils. The sheets were then dried to a moisture content of 18% and slit into small shreds of about 1 to 4 $in^2$ in area. The dried sheets were found to be about 7 mils thick.

The reconstituted tobacco from Sample A, having no pyrolyzed carbohydrate material contained therein, was combined with shredded all-tobacco leaf material and formed into cigarettes such that the total composition was 80% all-tobacco leaf material and 20% reconstituted tobacco. Sample B was combined with 7.5 pounds of all-tobacco leaf material and 1 pound reconstituted tobacco such that resulting cigarette contained 75% tobacco, 20% reconstituted tobacco and 5% pyrolyzed cellulose. Finally, to the reconstituted tobacco-pyrolyzed cellulose material of Sample C, 7.0 pounds of all-leaf tobacco material was added producing cigarettes having 70% tobacco leaf material, 20% reconstituted tobacco and 10% pyrolyzed alpha-cellulose.

The cigarettes formed from these respective samples were then analyzed for various smoking constituents. The results of that analysis are set forth in Table 1 below.

TABLE 1

| | Sample | | |
|---|---|---|---|
| | A | B | C |
| 1. Composition (%): | | | |
| Tobacco leaf | 80 | 75 | 70 |
| Reconstituted tobacco | 20 | 20 | 20 |
| Pyrolyzed α-cellulose (60% wt. loss) | — | 5 | 10 |
| 2. Cigarette Data: | | | |
| Weights (gms/cig) | 1.15 | 1.02 | 1.12 |
| RTD (inch $H_2O$) | 4.2 | 4.1 | 4.2 |
| 3. Smoking Data: | | | |
| TPM (mg/cig) | 28.3 | 25.8 | 23.7 |
| (% reduction) | | (9%) | (16%) |
| $H_2O$ (mg/cig) | 3.8 | 3.2 | 3.1 |
| (% reduction) | | (16%) | (18%) |
| Nicotine (mg/cig) | 1.51 | 1.36 | 1.27 |
| (%) reduction) | | (10%) | (16%) |
| Puff Count (puffs/cig) | 10.9 | 10.5 | 10.0 |
| (% reduction) | | (4%) | (8%) |
| *FTC Tar (mg/cig) | 22.99 | 21.24 | 19.33 |
| (% reduction) | | (8%) | (16%) |
| *FTC Tar mg/puff | 2.10 | 2.02 | 1.93 |
| (% reduction) | | (4%) | (8%) |

*These tests were performed by FTC approved method published in the Journal AOAC, Vol. 52, No. 5 (1969) pages 458–469 for determining the amount of tar in cigarette smoke.

As can be seen from the results shown in Table 1, the samples which contained the pyrolyzed alpha-cellulose material showed a reduction in constituents such as tar and nicotine and the sample which contained 10% pyrolyzed alpha-cellulose showed better results than the sample which only contained 5% pyrolyzed alpha-cellulose. The aroma and flavor of Samples A, B and C were in many respects similar, however, Samples B and C were found to be milder, smoother and less harsh to the nose and throat. Sample C was found to be the mildest and the least harsh of the three.

EXAMPLE 2

Example 1 was duplicated with the only exception being that the pyrolyzed carbohydrate material, the alpha-cellulose, was thermally degraded to the extent of an 85% weight loss. Samples D and E were made having the same proportion of materials as Samples B and C, respectively. The resulting product was formed into cigarettes and tested. The results of the analysis performed are set forth in Table 2 below.

TABLE 2

| | Sample | | |
|---|---|---|---|
| | A | D | E |
| 1. Composition (%): | | | |
| Tobacco leaf | 80 | 75 | 70 |
| Reconstituted tobacco | 20 | 20 | 20 |
| Pyrolyzedα-cellulose (85% wt. loss) | — | 5 | 10 |
| 2. Cigarette Data: | | | |
| Weights (gms/cig) | 1.15 | 1.12 | 1.12 |
| RTD (inch $H_2O$) | 4.2 | 3.8 | 4.0 |
| 3. Smoking Data: | | | |
| TPM (mg/cig) | 28.3 | 23.9 | 22.4 |
| (% reduction) | | (15%) | (21%) |
| $H_2O$ (mg/cig) | 3.8 | 2.9 | 2.6 |
| (% reduction) | | (24%) | (32%) |
| Nicotine (mg/cig) | 1.51 | 1.34 | 1.30 |
| (% reduction) | | (11%) | (14%) |
| Puff Count (puffs/cig) | 10.9 | 10.2 | 10.2 |
| (% reduction) | | (6%) | (6%) |
| FTC Tar (mg/cig) | 22.99 | 19.66 | 18.5 |
| (% reduction) | | (14%) | (19%) |
| FTC Tar mg/puff | 2.10 | 1.93 | 1.81 |
| (% reduction) | | (8%) | (14%) |

As can be seen from Table 2, substantial increases in the reduction of total particulate matter were realized in Examples D and E over those of Sample A and even over those of Samples B and C prepared in Example 1. Accordingly, the use of pyrolyzed cellulosic material which has the greatest weight loss during thermal degradation produced the highest reduction in the components of total particulate matter, particularly, the reduction of tar, nicotine, and puff count.

EXAMPLE 3

For purposes of comparison, Example 1 was repeated except that instead of adding pyrolyzed carbohydrate material to the tobacco slurry, activated carbon was added. The activated carbon used was that supplied by the Pittsburgh Carbon Company and identified as "R. B. pulverized".

As in Example 1, Sample A, the control sample, was prepared. New Samples X and Y were also prepared containing 5 and 10% activated carbon in the final product, respectively. Accordingly, Sample A, the control sample, contained 80% tobacco leaf material and 20% reconstituted tobacco. Sample X contained 75% tobacco leaf material, 20% reconstituted tobacco and 5% activated carbon. Finally, Sample Y contained 70% tobacco leaf material, 20% reconstituted tobacco and 10% activated carbon.

The cigarettes formed from these samples were tested and analyzed, the results of which are set forth in Table 3 below.

TABLE 3

| | Sample | | |
|---|---|---|---|
| | A | X | Y |
| 1. Composition (%): | | | |
| Tobacco leaf | 80 | 75 | 70 |
| Reconstituted tobacco | 20 | 20 | 20 |
| Activated Carbon | — | 5 | 10 |
| 2. Cigarette Data: | | | |
| Weights (gms/cig) | 1.15 | 1.12 | 1.12 |
| RTD (inch $H_2O$) | 4.2 | 3.9 | 4.0 |
| 3. Smoking Data: | | | |
| TPM (mg/cig) | 28.3 | 23.8 | 22.0 |
| (% reduction) | | (16%) | (22%) |
| $H_2O$ (mg/cig) | 3.8 | 3.2 | 2.5 |
| (% reduction) | | (16%) | (34%) |
| Nicotine (mg/cig) | 1.51 | 1.31 | 1.17 |
| (% reduction) | | (13%) | (25%) |
| Puff Count (puffs/cig) | 10.9 | 10.2 | 9.9 |
| (% reduction) | | (8%) | (9%) |
| FTC Tar (mg/cig) | 22.99 | 19.29 | 18.33 |
| (% reduction) | | (16%) | (20%) |
| FTC Tar mg/puff | 2.10 | 1.89 | 1.85 |
| (% reduction) | | (10%) | (12%) |

As can be seen by a comparison of the data set forth in Tables 2 and 3, the use of thermalized carbohydrate material (at the 85% weight loss level) in lieu of activated carbon produces results which are substantially equal. The thermalized carbohydrate material, however, provides for the additional advantages of a more acceptable balanced taste and body of smoke; a more uniform burning without the presence of sparking or firey particles; and less dustiness which the activated carbon does not possess.

EXAMPLE 4

A reconstituted tobacco slurry was formed in a manner similar to that described in Example 1. No pyrolyzed carbohydrate material was added to the slurry. Instead, potassium carbonate was added thereto. The slurry was then cast, dried, shredded into small strips and combined with tobacco leaf material to form the composition and smoking characteristics as set forth in Table 4 below.

EXAMPLE 5

Example 4 was repeated except that a greater quantity of potassium carbonate was added to the reconstituted tobacco slurry such that the composition and properties as set forth in Table 4 were obtained.

EXAMPLE 6

A reconstituted tobacco slurry was formed in a manner similar to that described in Example 1. Heat treated alpha-cellulose material pyrolyzed to a weight loss of 60% was then added to the slurry. The slurry was then cast, dried, shredded and combined with tobacco leaf material to form the composition having the properties as set forth in Table 4.

EXAMPLE 7

Example 6 was repeated except that in addition to the heat treated alpha-cellulose material, a quantity of potassium carbonate was also added. The final product composition, after combining with tobacco leaf material, and the properties associated therewith is set forth in Table 4 below.

EXAMPLE 8

Example 6 was once again repeated except that a greater quantity of heat treated alpha-cellulose material was added to the reconstituted tobacco slurry such that the composition and properties as set forth in Table 4 were obtained.

EXAMPLE 9

Example 8 was repeated except that a quantity of potassium carbonate was now added to the slurry. The final composition, after combining with tobacco leaf material, and the properties associated therewith are set forth in Table 4 below.

EXAMPLE 10

Example 6 was once again repeated such that the same quantity of heat treated alpha-cellulose is added to the reconstituted tobacco slurry except that the cellulose used was heat treated to the extent that there was an 85% weight loss. The final composition of the material tested and the properties obtained is set forth in Table 4 below.

EXAMPLE 11

Example 10 was repeated except that a quantity of potassium carbonate was added thereto. The results are set forth in Table 4 below.

EXAMPLE 12

Example 10 was repeated except that a greater quantity of the alpha-cellulose was added to the reconstituted slurry. The results are set forth in Table 4 below.

EXAMPLE 13

Example 12 was repeated except that in addition to the heat treated carbohydrate material, a quantity of potassium carbonate was added to produce a final product having the composition and properties as set forth in Table 4 below.

TABLE 4

| Example No. | Composition (%) | | TPM (mg/cig) | Nicotine (mg/cig) | FTC Tar (mg/cig) | Puff Count (puff/cig) | Tar (mg/puff) | Nicotine (mg/puff) |
|---|---|---|---|---|---|---|---|---|
| Control | Tobacco leaf | 80.0 | 25.1 | 1.30 | 20.3 | 10.1 | 2.0 | 0.13 |
| | Reconstituted Tob. | 20.0 | | | | | | |
| 4 | Tobacco leaf | 79.1 | 26.2 | 1.38 | 21.6 | 10.3 | 2.1 | 0.13 |
| | Reconstituted Tob. | 20.0 | | | | | | |
| | $K_2CO_3$ | 0.9 | | | | | | |
| 5 | Tobacco leaf | 78.1 | 25.3 | 1.33 | 21.0 | 9.8 | 2.1 | 0.14 |
| | Reconstituted Tob. | 20.0 | | | | | | |
| | $K_2CO_3$ | 1.9 | | | | | | |
| 6 | Tobacco leaf | 77.9 | 23.8 | 1.18 | 19.0 | 10.5 | 1.8 | 0.11 |
| | Reconstituted Tob. | 20.0 | | | | | | |
| | *HTC (60% wt loss) | 2.1 | | | | | | |
| 7 | Tobacco leaf | 77.0 | 23.7 | 1.20 | 18.9 | 11.0 | 1.7 | 0.11 |
| | Reconstituted Tob. | 20.0 | | | | | | |

TABLE 4-continued

| Example No. | Composition (%) | | TPM (mg/cig) | Nicotine (mg/cig) | FTC Tar (mg/cig) | Puff Count (puff/cig) | Tar (mg/puff) | Nicotine (mg/puff) |
|---|---|---|---|---|---|---|---|---|
| | HTC (60% wt loss) | 2.1 | | | | | | |
| | $K_2CO_3$ | 0.9 | | | | | | |
| 8 | Tobacco leaf | 75.8 | 24.5 | 1.19 | 19.6 | 9.8 | 2.0 | 0.12 |
| | Reconstituted Tob. | 20.0 | | | | | | |
| | HTC (60% wt loss) | 4.2 | | | | | | |
| 9 | Tobacco leaf | 73.9 | 23.0 | 1.10 | 18.5 | 10.6 | 1.7 | 0.10 |
| | Reconstituted Tob. | 20.0 | | | | | | |
| | HTC (60% wt loss) | 4.2 | | | | | | |
| | $K_2CO_3$ | 1.9 | | | | | | |
| 10 | Tobacco leaf | 77.9 | 24.0 | 1.14 | 19.3 | 10.4 | 1.9 | 0.11 |
| | Reconstituted Tob. | 20.0 | | | | | | |
| | HTC (85% wt loss) | 2.1 | | | | | | |
| 11 | Tobacco leaf | 77.0 | 23.6 | 1.20 | 18.7 | 10.9 | 1.7 | 0.11 |
| | Reconstituted Tob. | 20.0 | | | | | | |
| | HTC (85% wt loss) | 2.1 | | | | | | |
| | $K_2CO_3$ | 0.9 | | | | | | |
| 12 | Tobacco leaf | 75.8 | 23.8 | 1.14 | 18.8 | 10.6 | 1.8 | 0.11 |
| | Reconstituted Tob. | 20.0 | | | | | | |
| | HTC (85% wt loss) | 4.2 | | | | | | |
| 13 | Tobacco leaf | 73.9 | 21.8 | 1.07 | 17.4 | 10.3 | 1.7 | 0.10 |
| | Reconstituted Tob. | 20.0 | | | | | | |
| | HTC (85% wt loss) | 4.2 | | | | | | |
| | $K_2CO_3$ | 1.9 | | | | | | |

*For convenience, the term "heat treated carbohydrate material" has been abbreviated to HTC.

As can be seen from the Table, the material having the greatest reduction in tar, nicotine and puff count is the material of Example 13. This material contains the greatest percentage of heat treated carbohydrate material and potassium carbonate. Additionally, the carbohydrate material in Example 13 was pyrolyzed to an 85% weight loss. In comparison, in Example 9, where the additives and quantity of additives are identical except for the fact that the heat treated carbohydrate material used was pyrolyzed to a 60% weight loss, the results obtained although much better than the control, were not as good as those in Example 13. Consequently, it is seen that a carbohydrate material having a greater weight loss produces an end product having lower particulate matter.

Furthermore, in comparing Examples 4, 5, 6 and 7, it is seen that the use of potassium carbonate alone, without heat treated carbohydrate material, does not aid in the reduction of tar, nicotine and puff count of the end product. However, the use of potassium carbonate with a heat treated carbohydrate material produces results which are better (Example 7) than when the heat treated carbohydrate material is used alone (Example 6). A similar type result is seen when comparing Examples 10 and 11 wherein Example 10 uses only heat treated carbohydrate material and Example 11 uses both heat treated carbohydrate material and potassium carbonate. The flavor and aromatic properties of these materials were much improved producing a product having low tar but a higher subjective response, such as impact and body of smoke, than is usually characteristic with low tar cigarettes which are made by conventional methods such as filtration, air dilution, etc.

EXAMPLE 14

Examples 6 and 13 were repeated except that a quantity, 14 g per 10 pounds of final product weight, of the following acid mixture was also added in the slurries of the duplicated formulations of Examples 6 and 13:

| | | |
|---|---|---|
| Acid Mixture: | Methyl malonic acid | 2 parts |
| | Dimethyl malonic acid | 2 parts |
| | Ethyl malonic acid | 2 parts |

-continued

| | | |
|---|---|---|
| | Isopropyl malonic acid | 2 parts |
| | Sec-butyl malonic acid | 7 parts |

The cast-dried sheets were then shredded and compared to those of Examples 4, 6, and 13 at the 100% level (100% reconstituted product cigarettes) and in similar blends as those listed in Table 4 for Examples 4, 6, and 13.

The cigarettes that contained the fillers of Example 14 with the mixed acids were found to be more acceptable subjectively, richer in tobacco-like flavor (taste and aroma), and smoother in character than their corresponding controls (Examples 4, 6, and 13). The addition of the mixed acids did not affect the tar deliveries.

EXAMPLE 15

Example 14 was repeated except that the heat-treated alpha-cellulose was replaced with an equal quantity of Pittsburgh Carbon CO's R.B. pulverized activated carbon.

This material was then compared to that of Example 3. The materials of Example 15 were found to be much improved subjectively with regard to their subjective smoke qualities (taste and aroma). The characteristic "carbon" taste of Example 3 material was no longer noticeable in the products utilizing the Example 15 fillers. In addition, the material of Example 15 which contained a quantity of potassium carbonate in combination with the mixed acids was found to burn better and produce a lesser amount of falling firey particles from the burning zone. Subjectively, this filler produced products (cigarettes) which were characterized as having an even higher subjective response, more body and impact, than the rest of the fillers which did not contain potassium carbonate.

EXAMPLE 16

Example 15 was repeated except that in addition to the other additives, a quantity, 0.2 pounds/10 pounds of final product weight, of bentonite was used in the slurries. The materials of Example 16 were compared to those of Example 15, and were found to possess similar subjective smoke characteristics (taste, aroma) but the falling firey particles, characteristic to the Examples 1 and 15, were eliminated.

EXAMPLE 17

The previous Examples, 14–16, were repeated but instead of using the mixture of the malonic acids (see Example 14) a quantity, 0.6 pounds per 10 pounds of final product weight of the following mixture of magnesium salts was added in the slurries:

| | | |
|---|---|---|
| Salt Mixture: | Magnesium acetate | 1.0 part(s) |
| | Magnesium propionate | 0.2 parts |
| | Magnesium butyrate | 0.2 parts |
| | Magnesium iso-butyrate | 0.2 parts |
| | Magnesium valerate | 0.3 parts |
| | Magnesium iso-valerate | 0.4 parts |
| | Magnesium beta methyl valerate | 0.4 parts |

The fillers of Example 17 were found to possess similar and acceptable smoke characteristics as those of Examples 14–16.

EXAMPLE 18

The blends of Tables 1 and 2 were repeated but instead of adding the heat-treated material in the blend via a homogenized reconstituted tobacco, they were added as a separate entity in the blends, i.e., blended in the dry state. When these products were compared to those of Tables 1 and 2, they were found to be subjectively unacceptable with regard to flavor (taste, aroma); they produced an excessive amount of falling firey particles; the appearance of the cigarettes was damaged as the result of "black dust" on the white cigarette paper; and the side stream and room aroma was changed to that of "burning paper"-like.

EXAMPLE 19

The Examples 1, 2 and 3 were repeated but instead of homogenizing the carbonized materials in the tabacco slurry, they were simply mixed therein with no homogenization taking place at all. These materials were then compared to those of Examples 1, 2, 3 and 18.

The subjective smoke characteristics of the Example 19 materials were found to be more acceptable than those of Example 18 but worse than those of the Examples 1, 2, and 3 materials in that a pronounced foreign taste, aroma and irritation (burning paper-like) was noticed. Also, the smoke deliveries on a puff-by-puff basis were erratic ranging from about 0.5 mg tar/puff to about 2.2 mg tar/puff from one puff to the next. This was causing the cigarette taste to also be variable within one and the same cigarette product. The cigarettes containing the Example 19 materials were also found to be very high in falling firey particles at various puffs.

The sheet physical properties and appearance had also suffered in that lacey (streaky) sheets having weak sections and producing excessive amounts of dust during the cutting of the filler and cigarette making were made. All these deficiencies of the Example 19 materials were attributed to the non-homogeneity and excessive localization (concentration) of the heat-treated materials in the sheets.

Variations and modifications may, of course, be made without departing from the spirit and scope of the present invention.

Having thus described our invention, what we desire to secure by Letters Patent is:

We claim:

1. A method of producing a smokable material which comprises:

(a) pyrolyzing a carbohydrate material to a weight loss of at least 10%;

(b) forming a slurry of tobacco-parts;

(c) adding the pyrolyzed carbohydrate material to the slurry;

(d) homogenizing the slurry;

(e) adding an alkali metal salt selected from the group consisting of an alkali metal salt of a lower carboxylic acid, carbonate, bicarbonate, and phosphate to the homogenized slurry in an amount in the range of about 0.3 to 10% by weight based on the total dry weight of the slurry; and (f) processing the resultant product to a form desired for the smoking material.

2. The method of claim 1, wherein the amount of alkali metal salt added to the homogenized slurry is in the range of about 1 to 6% by weight based on the total dry weight of the slurry.

3. A method of producing a smokable material which comprises:

(a) pyrolyzing a carbohydrate material to a weight loss of at least 10%;

(b) forming a slurry of tobacco-parts;

(c) adding the pyrolyzed carbohydrate material to the slurry;

(d) homogenizing the slurry;

(e) adding a lower carboxylic acid or derivative thereof selected from the group consisting of formic, acetic, propionic, butyric, valeric, methyl valeric, isovaleric, secbutyl malonic, isopropyl malonic, ethyl malonic, methyl malonic and dimethyl malonic acid to the homogenized slurry in an amount in the range of about 0.2 to 10% by weight based on the total dry weight of the slurry; and (f) processing the resultant product to a form desired for the smoking material.

4. The method of claim 3, wherein the amount of acid added to homogenized slurry is in the range of about 0.3 to 5% by weight based on the total dry weight of the slurry.

5. The method of claims 1 or 4, wherein the carbohydrate material is selected from the group consisting of wood pulp, paper pulp, straw, flax, bamboo, esparto grass, kenaf fibers, cotton, hemp, rice fibers, vegetable fibers, coffee or peanut hulls and plant parts.

6. The method of claims 1 or 4, wherein the carbohydrate material is pyrolyzed at a temperature of at least about 100° C.

7. The method of claims 1 or 4, wherein the slurry of tobacco-parts is formed with an adhesive binder derived from natural tobacco parts.

8. The method of claim 7, wherein the binder is a pectin material.

9. The method of claims 1 or 4, wherein the slurry of tobacco-parts is formed with an adhesive binder which is a modified cellulose or natural gum selected from the group consisting of carboxymethyl cellulose or its salts, guar gum, alginates and ethyl hydroxy-ethyl cellulose.

10. The method of claims 1 or 4 which includes the step of pulverizing the pyrolyzed carbohydrate material prior to its being added to the tobacco-parts slurry.

11. The method of claim 10, wherein the pyrolyzed carbohydrate material is pulverized to less than about 450μ in diameter.

12. The method of claims 1 or 4, wherein about 5 to 80% on a dry weight basis of the pyrolyzed carbohydrate material is added to the slurry.

13. The method of claims 1 or 4, wherein the homogenization step is carried out such that about 2 to 5 gal/min of slurry is passed through a series of refiners maintained at a back pressure of about 60 psi such that a uniform homogeneous mixture is obtained.

14. The method of claim 1, wherein the carboxylic acid is selected from the group consisting of oxalic, acetic, citric, pivalic, malic and maleic acid.

15. The method of claim 4, wherein metallic or ammonium salts of these acids are added to the homogenized slurry.

16. The method of claims 1 or 4, wherein natural leaf tobacco is added to the homogenized slurry.

17. A smokable material having reduced tar and nicotine comprising:

(a) a pyrolyzed carbohydrate material homogenized with reconstituted tobacco; and (b) from about 0.3 to 10% by weight of an alkali metal salt selected from the group consisting of an alkali metal salt of a lower carboxylic acid, carbonate, bicarbonate and phosphate.

18. The material of claim 17, wherein the amount of alkali metal salt present is in the range of from about 1 to 6% by weight.

19. A smokable material having reduced tar and nicotine comprising:

(a) a pyrolyzed carbohydrate material homogenized with a reconstituted tobacco; and (b) from about 0.2 to 10% by weight of an acid selected from the group consisting of formic, acetic, propionic, butyric, valeric, methyl valeric, isovaleric, sec-butyl malonic, isopropyl malonic, ethyl malonic, methyl malonic and dimethyl malonic acid.

20. The material of claim 19, wherein the amount of acid present is in the range of from about 0.3 to 5% by weight.

21. The material of claims 17 or 19, wherein the carbohydrate material is selected from the group consisting of wood pulp, paper pulp, straw, flax, bamboo, esparto grass, kenaf fibers, cotton, hemp, rice fibers, vegetable fibers, coffee or peanut hulls and plant parts.

22. The material of claims 17 or 19, wherein the pyrolyzed material has been pyrolyzed to a weight loss of at least 10%.

23. The material of claims 17 or 19, wherein a natural tobacco adhesive binder is present.

24. The material of claims 17 or 19, wherein the binder is a pectin material.

25. The material of claims 17 or 19, wherein an adhesive binder which is a modified cellulose or natural gum selected from the group consisting of carboxymethyl cellulose or its salts, guar gum, alginates and ethyl hydroxyethyl cellulose is present.

26. The material of claims 17 or 19, wherein the pyrolyzed carbohydrate material is pulverized.

27. The material of claim 24, wherein the pyrolyzed carbohydrate material is less than 450μ in diameter.

28. The material of claim 19 which further includes metallic or ammonium salts of these acids.

29. The material of claims 17 or 18 which further includes natural tobacco.

30. The material of claim 17, wherein the carboxylic acid is selected from the group consisting of oxalic, acetic, citric, pivalic, malic and maleic acid.

31. The material of claim 19, wherein the pyrolyzed carbohydrate material is present in the amount of about 5 to 80% on a dry weight basis.

* * * * *